US006758583B2

(12) United States Patent
Hsu et al.

(10) Patent No.: US 6,758,583 B2
(45) Date of Patent: Jul. 6, 2004

(54) LIGHT SOURCE COOLING SYSTEM HAVING A DOUBLE EXHAUST FAN FOR A PROJECTOR

(75) Inventors: Nien-Hui Hsu, Hsin-Chu (TW); Ching-Chung Nien, Hsin-Chu (TW); Sen-Ming Hsu, Hsin-Chu (TW)

(73) Assignee: Coretronic Corporation, Hsinchu (TW)

( * ) Notice: Subject to any disclaimer, the term of this patent is extended or adjusted under 35 U.S.C. 154(b) by 58 days.

(21) Appl. No.: 10/063,146

(22) Filed: Mar. 25, 2002

(65) Prior Publication Data

US 2003/0043584 A1 Mar. 6, 2003

(30) Foreign Application Priority Data

Sep. 1, 2001 (TW) ..... 90122039 A

(51) Int. Cl.[7] ..... F21V 29/00

(52) U.S. Cl. ..... 362/373; 353/58; 353/61; 362/345

(58) Field of Search ..... 353/57–61; 362/294, 362/345, 373

(56) References Cited

U.S. PATENT DOCUMENTS 6,419,364 B2 * 7/2002 Takizawa et al. ..... 353/57
6,443,575 B1 * 9/2002 Miyamoto et al. ..... 353/58
6,488,378 B1 * 12/2002 Tabuchi et al. ..... 353/58

* cited by examiner

*Primary Examiner*—Stephen F. Husar
(74) *Attorney, Agent, or Firm*—Winston Hsu

(57) ABSTRACT

A light source cooling system having a double exhaust fan for a projector comprising: a light source formed with an interior region and an exterior region; a first exhaust fan; and a second exhaust fan, wherein the first exhaust fan and the second exhaust fan form two airstreams in the interior region and the exterior region respectively for cooperatively cooling the light source.

1 Claim, 1 Drawing Sheet

LIGHT SOURCE COOLING SYSTEM HAVING A DOUBLE EXHAUST FAN FOR A PROJECTOR

BACKGROUND OF INVENTION

1. Field of the Invention

The present invention relates to a projector, and more particularly to a light source cooling system having a double exhaust fan for a projectores.

2. Description of the Related Art

As the technology of projectors progresses, the power of the light sources of projectors appeared on the market is getting higher so that brighter images can be displayed on larger screens for bigger audiences. A prior art projector has a light source of 270 W that involves a problem in heat dissipation. A single exhaust fan of high rotation speed is used for cooling the light source in the prior art projector and results in an entire projector of a high noise level of 39 dB that can make users feel uncomfortable. Moreover, the high rotation speed of the exhaust fan implies a short life of the exhaust fan.

To resolve the above mentioned problem and disadvantage of the prior art projector, the inventor of the present invention got an inventive idea of providing a double fan of low rotation speed in a projector and proved by experiment that the noise level of the entire projector can be reduced to 32 dB by implementation of the inventive idea, in other words, compared with the noise level of the prior art projector, a reduction of 7 dB can be achieved. It can be understood by those of ordinary skill in the art that for every reduction of 3 dB, the noise energy consumed is half reduced and a reduction of 7 db means the noise energy consumed is reduced to less than one fourth. Obviously, an outstanding improvement can be achieved by use of the invention.

SUMMARY OF INVENTION

An object of the invention is to provide a light source cooling system having a double exhaust fan for a projector, wherein the operational rotation speed of the double exhaust fan, which has the rated highest speed of 4,800 r.p.m., is only about 2,400 r.p.m., i.e., only about a half of its rated highest speed and thereby the noise level of the projector is relatively low.

Another object of the invention is to provide a light source cooling system having a double exhaust fan for a projector, wherein the operational rotation speed of the double exhaust fan, which has the rated highest speed of 4,800 r.p.m., is only about 2,400 r.p.m., i.e., only about a half of its rated highest speed and thereby the life the double exhaust fan can be relatively long.

To achieve the above and other objects, the present invention provides a light source cooling system having a double exhaust fan for a projector comprising: a light source formed with an interior region and an exterior region; a first exhaust fan; and a second exhaust fan, wherein the first exhaust fan and the second exhaust fan form two airstreams in the interior region and the exterior region respectively for cooperatively cooling the light source.

BRIEF DESCRIPTION OF DRAWINGS

The above and other objects, advantages, and features of the present invention will be understood from the following detailed description of the invention when considered in connection with the accompanying drawing below.

DETAILED DESCRIPTION

Figure 1:
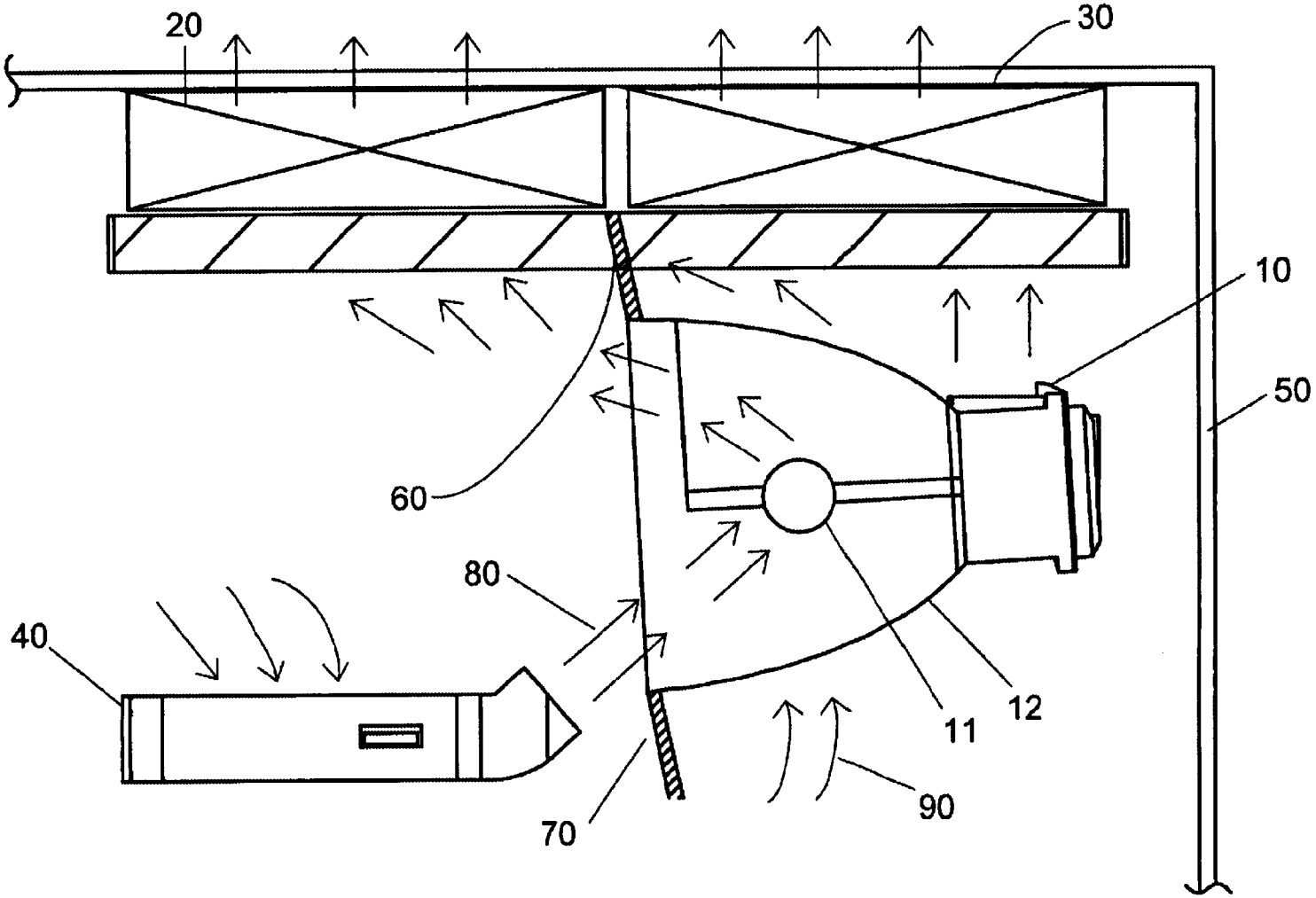
FIG. 1 is a schematic view showing a light source cooling system having a double exhaust fan for a projector in accordance with a preferred embodiment of the invention.

Referring to FIG. 1, a light source cooling system in accordance with a preferred embodiment of the invention comprises a light source 10 installed in a projector (not shown), two axial exhaust fans 20 and 30 attached to the case 50 of the projector, and a blower 40 installed in the projector. In the preferred embodiment, the thickness of the projector is, e.g., 80 mm, the size of both axial exhaust fans 20 and 30 is 70×70×20 mm, and the power of the light source 10 is 270 W.

The light source 10 has an outer reflector surface 12 and a light core 11 provided in the interior thereof. The exhaust fan 20 is adjacent the front end of the light source 10 and the exhaust fan 30 is adjacent the rear end of the light source 10. In front of the light source is provided a blower 40. The outlet of the blower 40 faces the light core 11.

A partition plate 60 separates the airflow for cooling the light source into two airstreams 80 and 90, wherein the airstream 80 generated by the exhaust fan 20 and the blower 40 is for cooling the light core 11 of the light source 10, and the airstream 90 that will pass through the exhaust fan 30 is for cooling the outer reflector surface 12 of the light source 10. It can be proved by experiment that the heat amount carried away, by the airstream 80, from the light core 11 of the light source 10 is about the same as that carried away, by the airstream 90, from the outer reflector surface 12 of the light source 10. Due to that two exhaust fans 20 and 30 are used in the projector, they only need a rotation speed of 2,400 r.p.m. to achieve a desirable cooling effect on the light source 10. In addition, it can be proved by experiment that the noise level of the entire projector can be reduced to 32 dB, in other words, compared with the noise level of the prior art projector, a reduction of 7 dB can be achieved. It can be understood by those of ordinary skill in the art that for every reduction of 3 dB, the noise energy consumed is half reduced and a reduction of 7 db means the noise energy consumed is reduced to less than one fourth. Obviously, an outstanding improvement can be achieved by use of the invention. Moreover, the operational rotation speed of the exhaust fans 20 and 30 is only about 2,400 r.p.m. instead of 4,800 r.p.m. (i.e., the rated highest rotation speed of the fans), thereby the exhaust fans 20 and 30 can have a relatively long life.

While a preferred and particular embodiment of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A light source cooling system having a double exhaust fan for a projector comprising:

a light source formed with an interior region and an exterior region;

a blower which has a outlet facing the interior region;

a first exhaust fan which is adjacent a front end of the light source; and a second exhaust fan which is adjacent a rear end of the light source;

wherein the blower cooperatively operates with the first exhaust fan to generate a first airstream for cooling the interior region, the second exhaust fan forming a second airstream for cooling the exterior region.

* * * * *